US009528662B2

(12) United States Patent
Wang et al.

(10) Patent No.: US 9,528,662 B2
(45) Date of Patent: Dec. 27, 2016

(54) LED LIGHTING DEVICE

(71) Applicant: Digital Power Company Limited, Cayman (KY)

(72) Inventors: Calvin Shie-Ning Wang, Cayman Islands (KY); Zhen-Qiu Huang, Cayman Islands (KY)

(73) Assignee: Digital Power Company Limited, Cayman (KY)

( * ) Notice: Subject to any disclaimer, the term of this patent is extended or adjusted under 35 U.S.C. 154(b) by 107 days.

(21) Appl. No.: 14/501,895

(22) Filed: Sep. 30, 2014

(65) Prior Publication Data

US 2015/0184808 A1 Jul. 2, 2015

(30) Foreign Application Priority Data

Dec. 27, 2013 (CN) ..... 2013 1 0734754

(51) Int. Cl.
*F21V 29/507* (2015.01)
*F21K 99/00* (2016.01)
(Continued)

(52) U.S. Cl.
CPC . *F21K 9/30* (2013.01); *F21K 9/20* (2016.08); *F21S 2/005* (2013.01); *F21V 17/164* (2013.01); *F21V 23/006* (2013.01); *F21V 23/009* (2013.01); *F21V 25/00* (2013.01); *F21V 29/004* (2013.01); *F21V 29/507* (2015.01); *F21V 29/74* (2015.01); *F21V 29/76* (2015.01); *F21V 29/83* (2015.01); *F21V 7/22* (2013.01); *F21Y 2101/00* (2013.01); *F21Y 2113/00* (2013.01); *H05B 33/0815* (2013.01)

(58) Field of Classification Search
CPC ..... F21K 9/30; F21K 9/20; F21V 15/011; F21V 29/2206; F21V 23/006; F21V 29/507; F21V 7/22; F21V 1/00; F21V 1/14; F21V 29/004; F21V 29/2293; F21V 29/76; F21V 17/164; F21V 17/10; F21V 25/00; F21V 23/009; F21V 29/83; F21V 29/74; F21S 2/005; F21Y 2113/00; F21Y 2101/02; F21Y 2101/00; H05B 33/0815
See application file for complete search history.

(56) References Cited

U.S. PATENT DOCUMENTS 8,858,028 B2 * 10/2014 Kim ..... F21V 29/004 362/249.02
2011/0305012 A1 * 12/2011 Lo ..... F21K 9/13 362/218
(Continued)

FOREIGN PATENT DOCUMENTS

CN 101487574 A 7/2009
CN 102022681 A 4/2010
(Continued)

*Primary Examiner* — Bao Q Truong
(74) *Attorney, Agent, or Firm* — Zhigang Ma

(57) ABSTRACT

The invention provides an LED lighting device having a plurality of LED modules. Each LED module includes a housing structure, a plurality of LEDs disposed on the housing structure and a power converter that provides power to the LEDs. Each power converter of the LED modules operates independently. The LED lighting device of the present invention is more difficult to fail and may effectively reduce maintenance costs.

20 Claims, 16 Drawing Sheets

(51) Int. Cl.

| | |
|---|---|
| ***F21V 23/00*** | (2015.01) |
| ***F21V 29/00*** | (2015.01) |
| ***F21V 29/76*** | (2015.01) |
| ***F21S 2/00*** | (2016.01) |
| ***F21V 17/16*** | (2006.01) |
| ***F21V 25/00*** | (2006.01) |
| ***F21V 29/74*** | (2015.01) |
| ***F21V 29/83*** | (2015.01) |
| *F21V 7/22* | (2006.01) |
| *F21Y 113/00* | (2016.01) |
| *H05B 33/08* | (2006.01) |
| *F21Y 101/00* | (2016.01) |

(56) References Cited

U.S. PATENT DOCUMENTS

| | | | | |
|---|---|---|---|---|
| 2014/0169004 | A1* | 6/2014 | Nakajima | F21S 8/026<br>362/373 |
| 2015/0109792 | A1* | 4/2015 | Ishida | F21K 9/50<br>362/294 |

FOREIGN PATENT DOCUMENTS

| | | | |
|---|---|---|---|
| CN | 201589156 | Y | 9/2010 |
| CN | 202132902 | U | 2/2012 |
| TW | 201141303 | Y | 11/2011 |
| TW | 201219703 | Y | 5/2012 |

* cited by examiner

LED LIGHTING DEVICE

CROSS-REFERENCE TO RELATED APPLICATIONS

This application claims priority to Chinese Patent Application No. 201310734754.5 filed on Dec. 27, 2013 in the State Intellectual Property Office Of The P. R. C., the contents of which are incorporated by reference herein.

FIELD

The present invention relates generally to a lighting device. More specifically, to a light emitting diode (LED) light device.

BACKGROUND

Light emitting diodes (LEDs) have been widely adopted in various applications as a new source of lighting. In particular, as a lighting source for places such as streets, courtyards, tunnels, plaza and etc. In general, current LED lighting device assembly includes a lamp post, a lighting frame mounted on the top of the lamp post and a power converter installed therein. The lighting frame includes a housing structure, a LED light source disposed in the housing structure, a cooling mechanism for dissipating the heat generated from the light source and a drive control circuit for power linking between the light source and an electricity source. The power converter converts external alternating current (AC) to direct current (DC) and transmits through the drive control circuit to power the light source, thereby achieving illumination.

However, current LED lighting devices link all light sources to a single power converter and the power converter usually has a shorter operating lifetime compared to that of the light sources. In particular, if the lighting device is adopted as a street lamp, the power converter may be easily damaged from lightning strikes. A failed power converter may hinder the flow of electrical current to all the light sources, resulting in a complete breakdown of the entire lighting device. In addition, the follow-up repair and maintenance can be tedious, resulting in an increased cost.

Accordingly, there is a need in the art for a LED lighting device that is more durable.

BRIEF DESCRIPTION OF THE DRAWINGS

Implementations of the present technology will now be described, by way of example only, with reference to the attached figures.

DETAILED DESCRIPTION OF EMBODIMENTS

Figure 1:
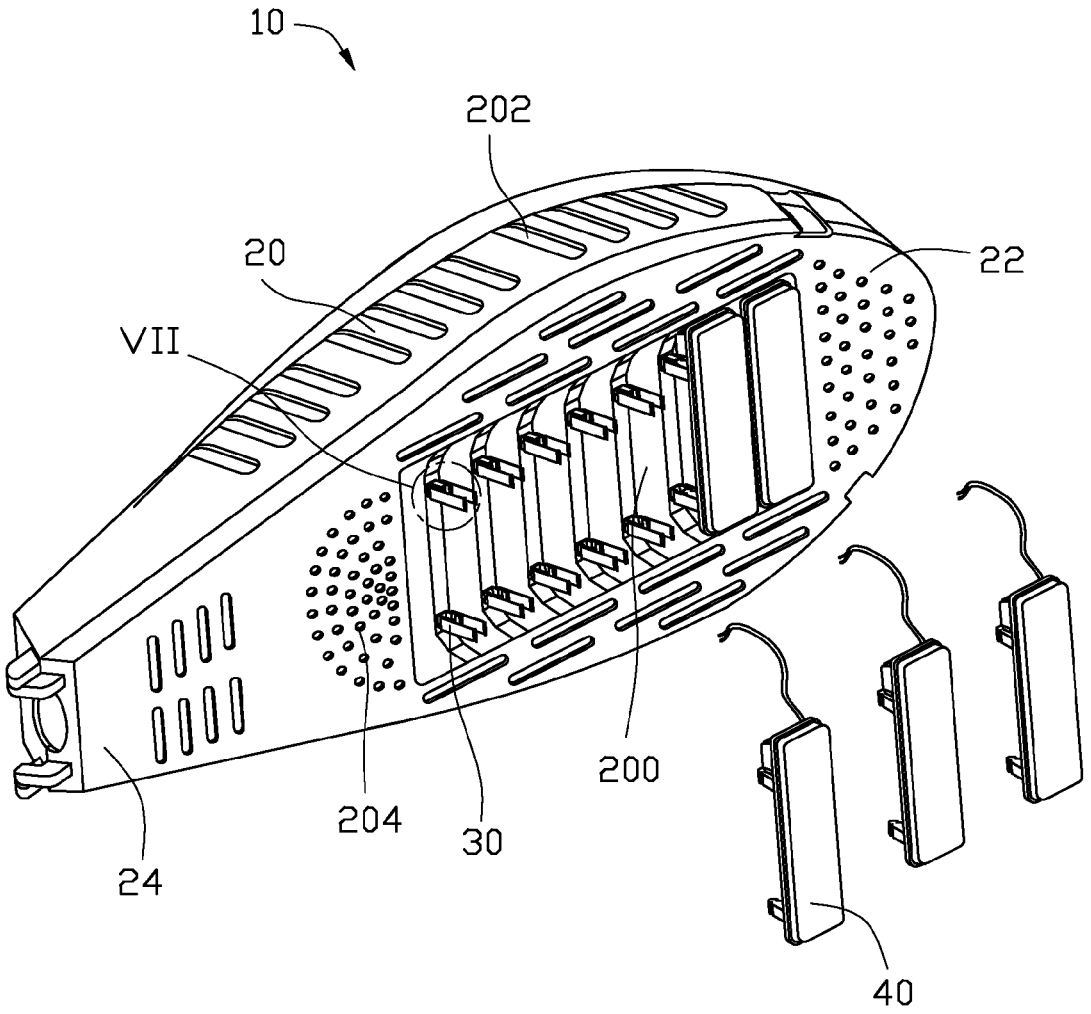
FIG. 1 is an exploded perspective view of the LED lighting device according to first embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof. The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, layer or section. Thus, a first element, component, region, part or section discussed below could be termed a second element, component, region, layer or section without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present invention in conjunction with the accompanying drawings in FIGS. 1-16. Reference will be made to the drawing figures to describe the present invention in detail, wherein depicted elements are not necessarily shown to scale and wherein like or similar elements are designated by same or similar reference numeral through the several views and same or similar terminology.

FIG. 1 illustrates the LED lighting device 10 according to one embodiment of the present invention in a schematic form. The LED lighting device 10 is a street lamp for illuminating the streets. The LED lighting device 10 includes a lighting frame 20, a plurality of fastening components 30 disposed on the lighting frame 20, and a plurality of LED modules 40 attached to the fastening components 30.

The lighting frame 20 is constructed with metallic materials and has a larger end 22 and a smaller end 24. During installation, the larger end 22 of the lighting frame 20 faces toward the street surface, while the smaller end 24 is mounted on the lamp post located besides the street, thereby illuminating the street with the LED module 40. The bottom part of the lighting frame 20 forms a cavity 200 that encloses the fastening components 30 and the LED modules 40. The sidewall of the lighting frame 20 corresponding to the cavity 200 includes a plurality of slots 202, the surrounding of the bottom of the cavity 200 includes a plurality of openings 204 to dissipates the heat, thereby enhancing the cooling of the lighting frame 20.

Figure 2:
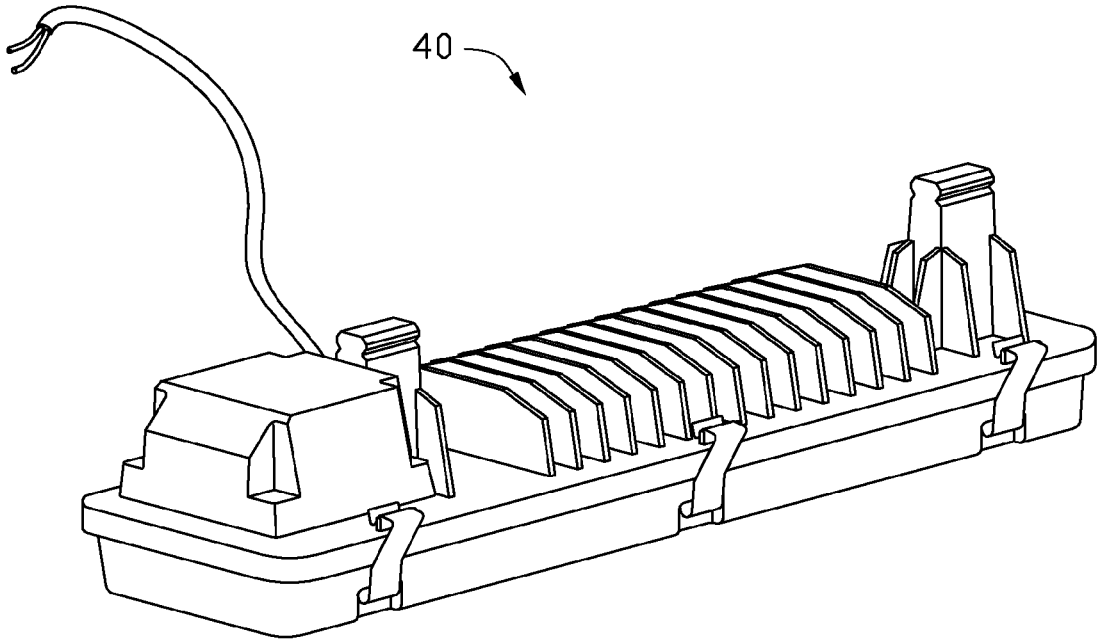
FIG. 2 is an enlarged view of a LED module of the LED lighting device of FIG. 1.
Figure 3:
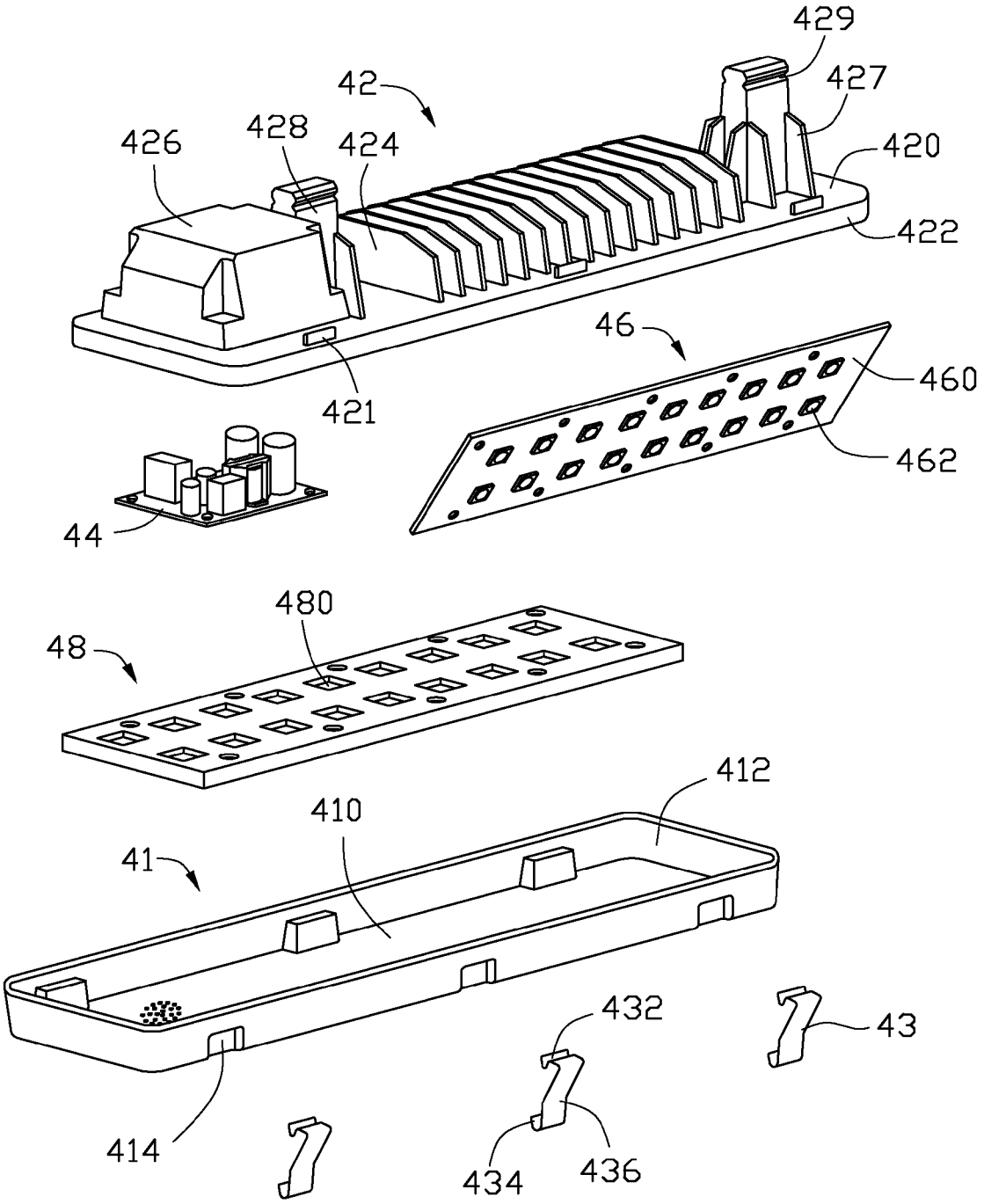
FIG. 3 is an exploded perspective view of the LED module of FIG. 2.
Figure 4:
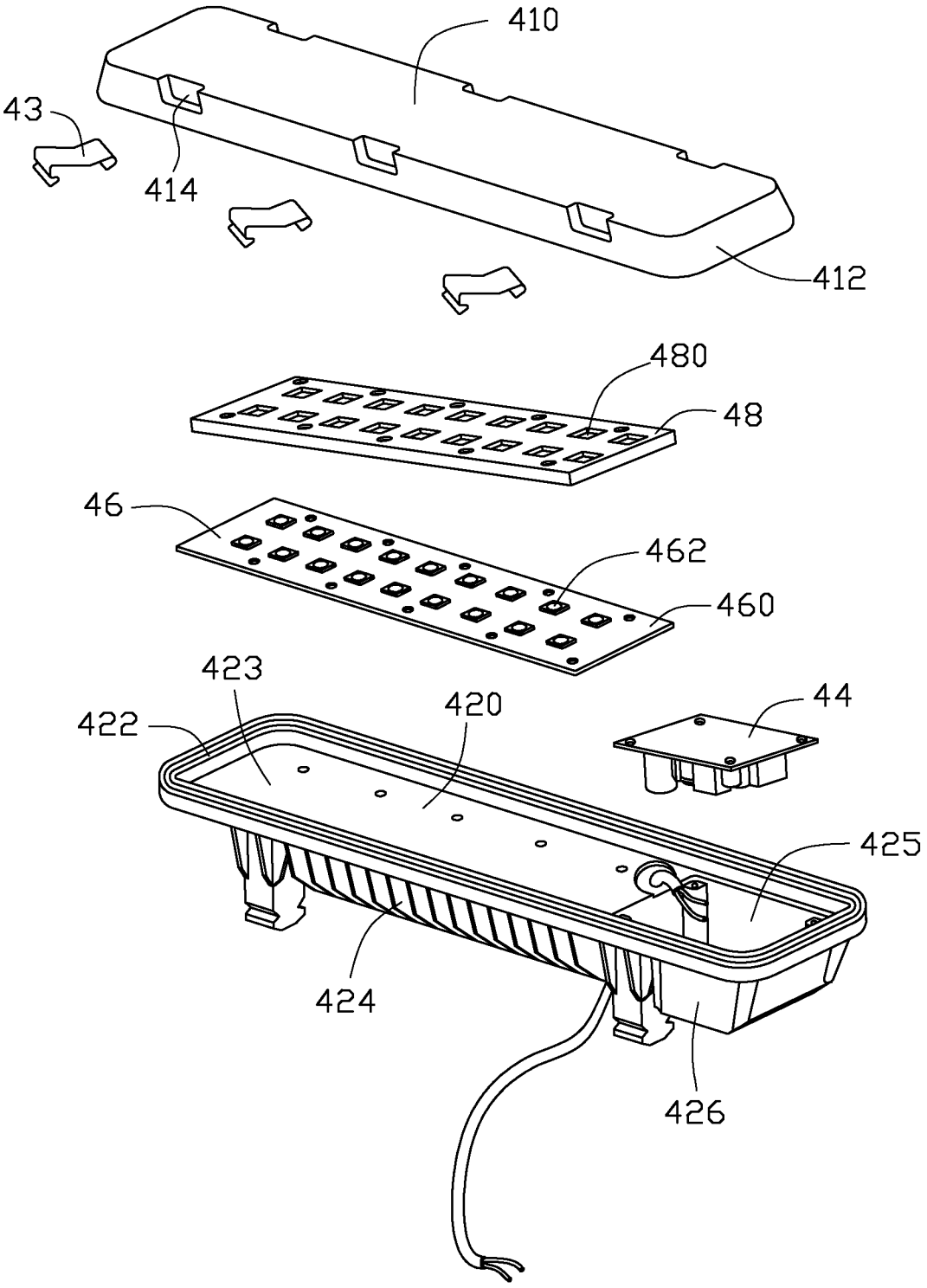
FIG. 4 is a bottom view of the LED module of FIG. 3.

Referring to FIGS. 2-4, each LED module 40 includes a housing structure 42, a power converter 44 that is disposed on the housing structure 42, a lamp plate 46 that is assembled with the housing structure 42, a reflector 48 that covers the lamp plate 46, a lampshade 41 that covers the reflector 48, and a plurality of flexible hooks 43 that clamp the lampshade 41 to the housing structure 42. In one embodiment of the present invention, the housing structure 42 is constructed in one piece with electrical insulating and thermal conducting materials, for example, a thermal plastic material with a thermal conductivity preceded only by metal. Accordingly, the power converter 44 disposed on the housing structure 42 does not require an isolation design owing to electric insulation (isolation design adopts an electrical insulating housing to cover the power converter 44, thus eliminating direct contact with the housing structure 42), thereby enhancing the power factor of the power converter 44. The housing structure 42 includes a substrate 420, a side plate 422 that extends from the surrounds of the substrate 420, a plurality of fins 424 that extend from the top of the substrate 420, a cavity 426 that protrudes from the top of the substrate 420, and two columns 428 that extend from the top of the substrate 420. The substrate 420 is a rectangular flat panel, wherein a plurality of internal threads is designated on the bottom part, where screws may be used to assemble a lamp plate 46 to the substrate 420. The side plate 422 extends downward from the surrounds of the substrate 420, and in conjunction with the substrate 420, a cavity 423 is formed that encloses the lamp plate 46. The fins 424 are aligned in perpendicular on the top of the substrates 420 and each is separated in parallel with an interval. The interval between each separated fin 424 creates space for airflow, thus enhancing the cooling of the housing structure 42. The shapes of the fins 424 are not limited to the illustrated panel shape as shown in the figures, the fins can be adapted to various shapes according to the actual needs (for example, the amount of cooling required for the LED module 40). In addition, the fins 424 can also be adapted to various arrangements, for example, cross arrangement, vertical arrangement and etc. It is appreciated that the use of fins as a cooling mechanism is only one variant of the embodiments. Other cooling mechanism designs, including the aforementioned fins design, may be adopted for the LED module 40. The cavity 426 and the fins 424 are arranged in series on top of the substrate 420. The inside of the cavity 426 forms a housing space 425 that may be used to enclose a power converter 44. The housing space 425 is taller than a notch 423 and is interconnected with the notch 423. The two columns 428 are positioned at the opposite sides of the fins 424. Each column 428 is fixed onto the substrate 420 and is strengthened with a plurality of stiffeners 427. The height of the column 428 is greater than the cavity 426 and the fins 424. The opposite sides close to the top of the column 428 forms two slots 429. The two slots 429 are positioned in parallel to each other and are extended in the direction perpendicular to the fins 424. Each slot 429 has a V-shaped cross-section that may be secured with the fastening component 30, thereby connecting the housing structure 42 with the lighting frame 20. The opposite sides on the top of the substrate 420 includes a plurality of protruding parts 421 that provide connecting regions for the flexible hooks 43. In one embodiment of the present invention, each side of the substrate 420 comprises three protruding parts 421 that correspond to the positions of the cavity 426, the fins 424 and one column 428, respectively. Each protruding part has a height much less than that of the fins 424.

Figure 5:
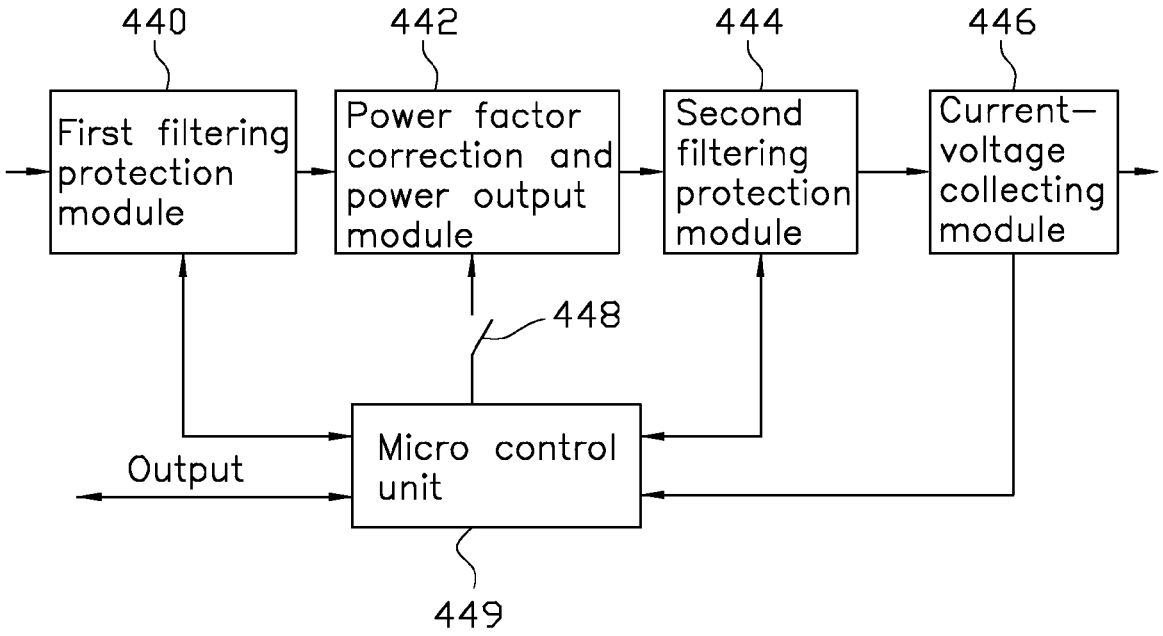
FIG. 5 is a block diagram of an electric circuit of the power converter of the LED module of FIG. 2.

Referring to FIG. 5, the power converter 44 is enclosed in the housing space 425 of the cavity 426. The method for assembling the power converter 44 to the cavity 426 includes, but not limited to, clipping, adhesive bonding, fastening and etc. The power converter 44 may be a digital current converter or an analog power converter that converts alternating current to direct current. In one embodiment of the present invention, the power converter 44 is a digital power converter, which includes a first filtering protection module 440, a power factor correction and power output module 442, a second filtering protection module 444, a current-voltage collecting module 446, a switch 448 and a micro control unit 449. The input of the first filtering protection module 440 is connected with an external power source. The output of the first filtering protection module 440 is connected with the input of the power factor correction and power output module 442. The output of the power factor correction and power output module 442 is connected with the input of the second filtering protection module 444. The output of the second filtering protection module 444 is connected with the input of the current-voltage collecting module 446. One of the outputs of the current-voltage collecting module 446 is connected with the lamp plate 46, and the other output is connected with the micro control unit 449. The micro control unit 449 is also connected with the first filtering protection module 440 and the second filtering protection module 444, and is also connected with the power factor correction and power output module 442 through the switch 448. The first filtering protection module 440 is an EMI (Electromagnetic Interference) filter that transmits the external alternating current to the power converter 44 while filtering the electromagnetic radiation and transmittance interference. The power factor correction and power output module 442 is adapted to correct and adjust the current/voltage, thereby enhancing the power factor of the LED lighting device 10 while at the same time converting alternating current to direct current. Since the housing structure 42 is constructed with electrical insulating and thermal conducting materials, the power factor correction and power output module 442 may adopts a non-isolating electric circuit to increase the power factor. The second filtering protection module 444 is adapted to decrease the ripple of the corrected current and it may also be adopted as an EMI filter. The current-voltage collecting module 446 is adapted to transmit the feedback readings of the corrected current/voltage to the micro control unit 449, and it is also adapted to send the corrected direct current to the lamp plate 46. According to the feedback readings, the micro control unit 449 digitally transmits the PWM (Pulse Width Modulation) signals to drives the switch 448 to control the power factor correction and power output module 442, thereby modeling a resistive load, controlling the power factor correction and power output automatically, and achieving high power factor, high efficiency and low standby power. It is appreciated that while aforementioned control uses a single switch 448, two or more switches may also be adopted into the digital control design. The micro control unit 449 is a micro processing chip that calculates and generates the commands through time. The processing chip may include memories and receivers that receive external signals such as infrared, Bluetooth, WiFi and PLC (Power Line Communication). According to the received external signals, the built-in firmware of the processing chip adjusts the PWM signal output, thereby adjusting the brightness of the LED module 40 (For example, adjusting the brightness of the LED module 40 to 30% of the maximum brightness at 8:00 PM, adjusting the brightness of the LED module 40 to 70% of the maximum brightness at 9:00 PM, and adjusting the brightness of the LED module 40 to 100% of the maximum brightness at 10:00 PM). The switch 448 may be a MOSFET (Metal-Oxide Semiconductor Field Effect Transistor), an IGBT (Insulated Gate Bipolar Transistor) or a bipolar transistor, wherein the bipolar transistor may be used for small power factor, the IGBT may be used for large power factor, and the MOSFET may be used for other situations. In one embodiment of the present invention, the AC input may be in a range of 100V to 240V with a current that is not greater than 0.4 A, and voltage output is between 50V to 65V with a current of 450 mA+−5%, which may drives a lamp plate 46 with a series of 18 LEDs 462 or drives a lamp plate 46 with three series of 6 LEDs 462.

The lamp plate 46 includes an electric circuit board 460 and a plurality of LEDs 462 disposed on the electric circuit board 460. The electric circuit board 460 may be constructed with aluminum substrate which forms an electrical insulating alumina when contacting with the air, thereby providing higher electrical insulating and thermal conducting capabilities. The bottom section of the electric circuit board 460 further comprises electric circuits which may be constructed with copper foil that develops into particular patterns through etching. The top part of the electric circuit board 460 adheres to the bottom part of the substrate 420 of the housing structure 42, thereby transferring the heat generated from the LEDs 462 to the housing structure 42, and dissipating the heat externally through the fins 424 of the housing structure 42. The electric circuit board 460 may be fastened to the substrate 420 with screws or fixed to the substrate 420 with other techniques such as clipping or adhesive bonding. The LEDs 462 are disposed to the bottom part of the electric circuit board 460 and connected with the electric circuit. The LEDs 462 may be connected in series or in parallel, depending on the actual needs. The power factor, category, quantity, size, brightness, color, color temperature and etc of the LEDs 462 may also be selected depending on the actual needs. Preferably, in one embodiment of the present invention, a total of 18 white LEDs 462 are adopted for illumination.

The reflector 48 covers the lamp plate 46, wherein the surface corresponds to the LEDs 462 comprises a plurality of openings 480, which encloses each LED in an individual opening. In one embodiment of the present invention, the reflector 48 is constructed with chrome coated plastic materials. Preferably, the bottom part of the reflector 48 face towards the lampshade 41, and the inner sidewall of each individual opening 480 are coated with chrome layers, which reflect the light emitted from the LEDs 462 to the lampshade 41, thereby enhancing the light output efficiency of the LED module 40. The top of the reflector 48 face towards the lamp plate 46 is not coated with chrome, thus preventing short circuiting the electric connection between the reflector 48 and the lamp plate 46. The reflector 48 may be fastened to the substrate 420 of the housing structure 42 with screws, or clamped to the lamp plate 46 with the lampshade 41 or fixed with other techniques.

Figure 6:
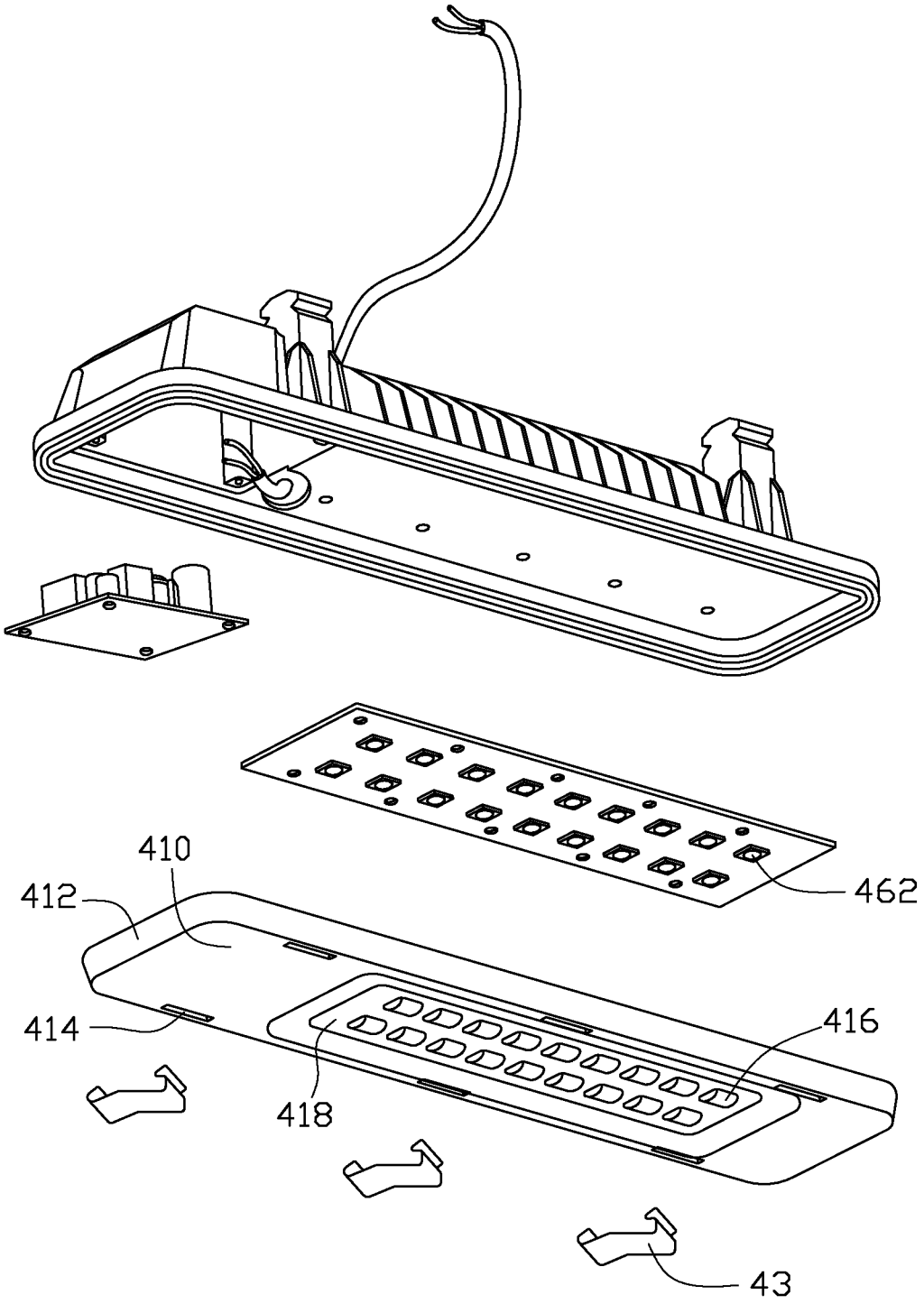
FIG. 6 is a exploded perspective view of the LED module of the LED lighting device according to second embodiment of the present invention.

The lampshade 41 is attached to the housing structure 42 and covers the reflector 48. The lampshade 41 is constructed in one piece with transparent materials such as polycarbonate, polymethacrylates, glass and etc. The lampshade 41 includes a bottom plate 410 and a sidewall 412 formed at the surrounding of the bottom plate 410. The sidewall 412 comprises a plurality of concaves 414 with correspond to the positions of the protruding parts 421 of the housing structure 42. The bottom of each concave 414 is located within the sidewall 412 and the bottom plate 410, and the top is lower than the top of the sidewall 412. During the assembly of the lampshade 41 to the housing structure 42, the top of the sidewall 412 would be in contact with the bottom of the side plate 422 of the housing structure 42. The bottom plate 410 is located below the reflector 48, thus covering the notch 423 of the housing structure 42. In addition, each concave 414 of the lampshade 41 is individually aligned with each protruding part 421 of the housing structure 42, thereby clamping the lampshade 41 to the housing structure 42 with flexible hooks 43. It is appreciated that, as shown in FIG. 6, the bottom part of the bottom plate 410 of the lampshade 41 may correspond to the position of each LED 462 to forms a plurality of lens 416 that further adjusts the light path of the LED 462, thereby obtaining an ideal light pattern. In this case, the bottom of the lampshade 41 forms a concaved region 418, and the lens 416 form inside the concaved region 418. In addition, the concave 414 of the lampshade 41 is located at the bottom of the bottom plate 410 by the sidewall 412, the flexible hook 43 clamps the protruding part 421 of the housing structure 42 and the concave 414 of the lampshade 41 into place. In addition, the reflector 48 may be joint as one with the lampshade 41, where the top of the lampshade 41 comprises openings 480, and the openings 480 reach to the bottom of the bottom plate 410 but do not penetrate through the bottom of the lampshade 41. The LEDs 462 are enclosed in the openings 480. The inner sidewall of the openings 480 is chrome coated which reflecting the light of the LEDs 462. It is appreciated that the design of the reflector is just one of the embodiments for the secondary optical mechanism, while other secondary optical mechanism designs may be adapted to the LED module 40.

The flexible hooks 43 clamp the lampshade 41 to the housing structure 42. Each flexible hook 43 may be constructed in one piece with metal foil. Each flexible hook 43 forms a "W" shape, wherein the top and bottom two ends form a first clasp part 432 and a second clasp part 434, while the center forms a "V" shaped connection part 436. Each flexible hook 43 comprises a first clasp part 432 that clamps to the protruding part 421 of the housing structure 42 and rests on the top of the substrate 420 of the housing structure 42, a second clasp part 434 that clamps to the corresponding concave 414 of the lampshade 41, and a connection part 436 that rests on the outside face of the side plate 422 of the housing structure 42, thereby securing the lampshade 41 to the housing structure 42. Since the lampshade 41 is secured to the housing structure 42 with the flexible hooks 43, the assembling and disassembling of the lampshade 41 and the housing structure 42 is straightforward and may be completed without the need of screws or additional tools, resulting in a quicker installation, maintenance and repair of the LED module 40.

Figure 7:
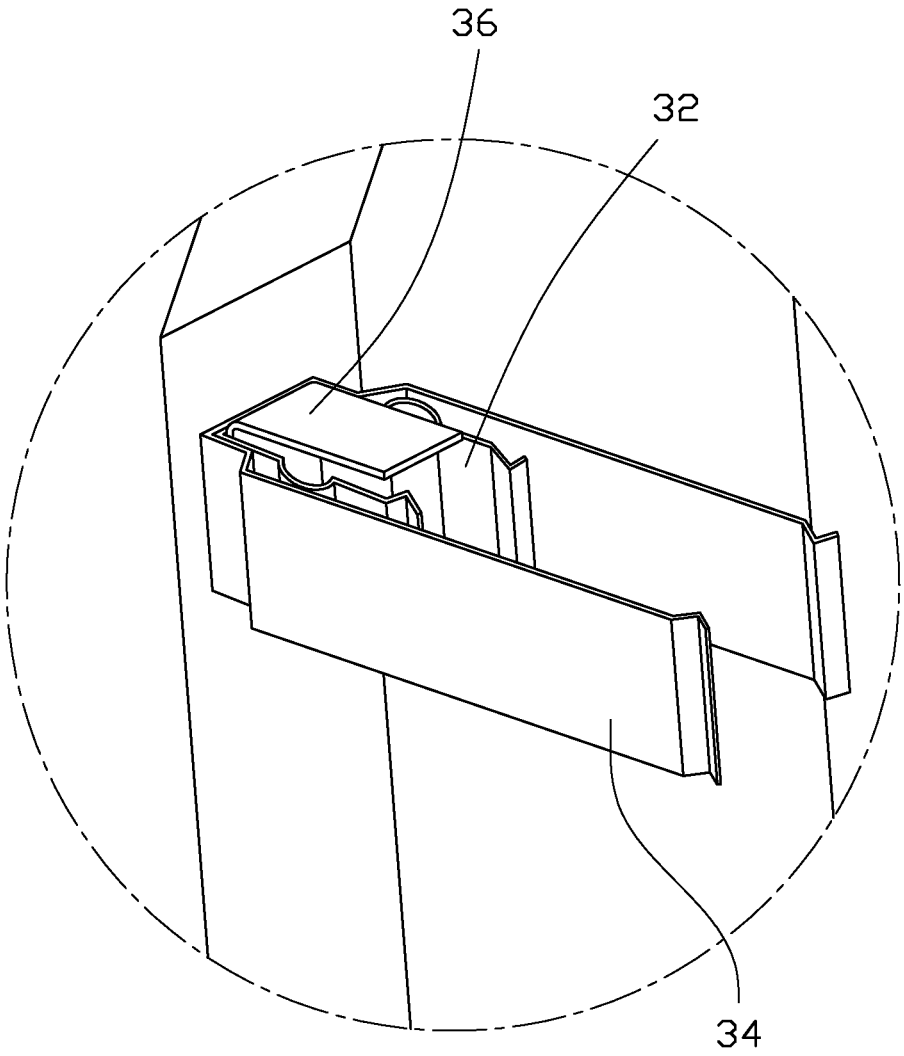
FIG. 7 is an enlarged sectional view of the LED lighting device of FIG. 1.
Figure 8:
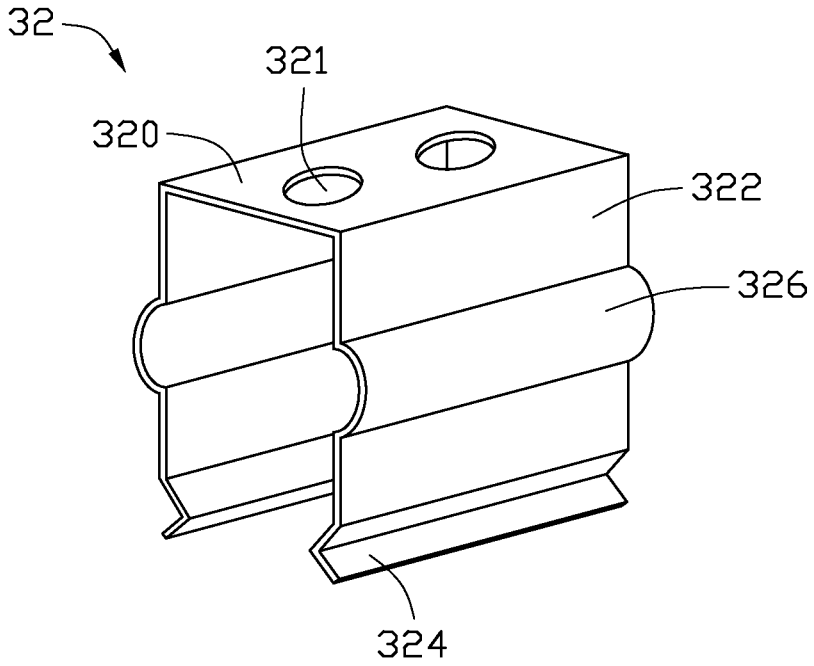
FIG. 8 is an enlarged view of the positioning clip of the LED lighting device of FIG. 1.

Referring to FIGS. 7-8, the fastening component 30 includes a positioning clip 32. The positioning clip 32 includes a connecting plate 320 and two flexible wings 322 that extend downward from the opposite sides of the connecting plate 320. The connecting plate 320 includes two internal threads 321 that provide the fastening of the connecting plate 320 to the cavity 200 of the lighting frame 20 with screws. Each top end of the flexible wing 322 connects to the connecting plate 320, the bottom end bends inward to form a "V" shaped slotting region 324, and the center bends outward to form an arc-shaped protruded region 326. The slotting region 324 of the two flexible wings 322 of the positioning clip 32 clamps with the two slots 429 of the column 428 of the housing structure 42, thereby fixing the housing structure 42 to the lighting frame 20. The protruded region 326 is adopted to increase the flexibility of the flexible wing 322, thus making the flexible wing 322 clamps to the column 428 more reliably.

Figure 9:
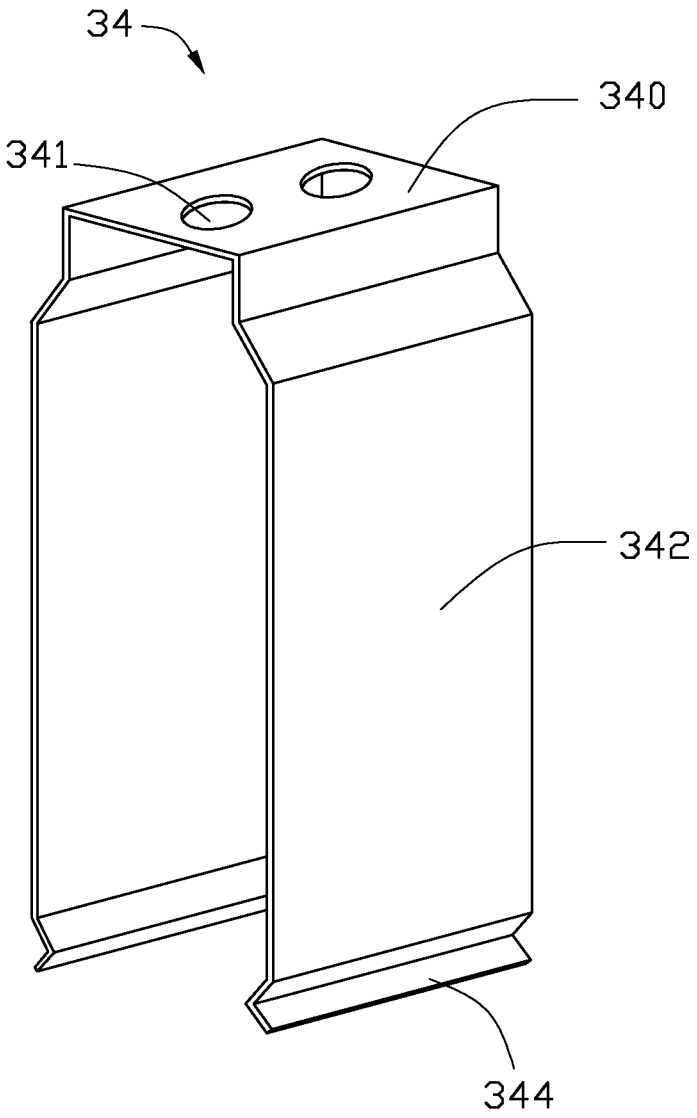
FIG. 9 is an enlarged view of the supporting clip of the LED lighting device of FIG. 1.
Figure 10:
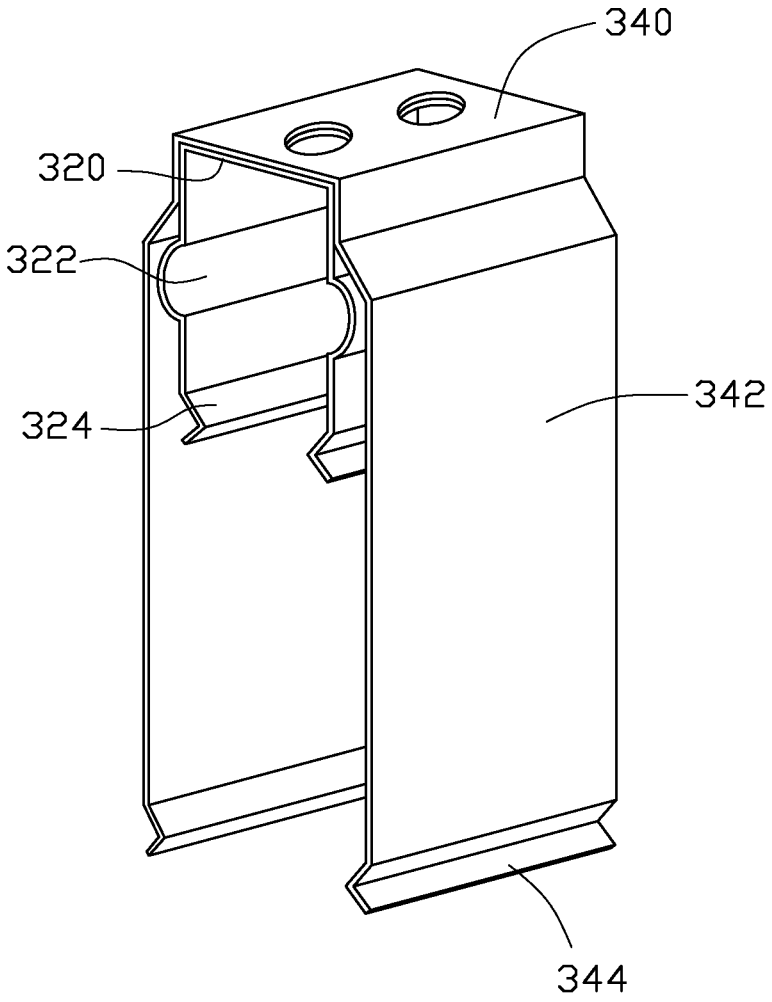
FIG. 10 is an assembled view of the positioning clip of FIG. 8 and the supporting clip of FIG. 9.

Referring to FIGS. 9-10, the fastening component 30 further includes a supporting clip 34. The supporting clip 34 may be used in conjunction with the positioning clip 32 of the fastening component 30, or may be used alone (That is, the fastening component 30 includes only the supporting clip 34). The supporting clip 34 includes a fixing plate 340 and two supporting wings 342. The fixing plate 340 includes two internal threads 341 that provide the fastening of the fixing plate 340 to the cavity 200 of the lighting frame 20 with screws. The width of the fixing plate 340 is greater than that of the connecting plate 320, and the length of the supporting wing 342 is greater than that of the flexible wing 322. Each top end of the supporting wing 342 inclines inward and then extends upward to connects with the fixing plate 340, the bottom end of the supporting wing 342 also bends inward to form a "V" shaped slotting region. When the supporting clip 34 is used alone, the slotting region 344 may connects to the slots 429 of the column 428 of the housing structure 42, thereby clamping the housing structure 42 to the lighting frame 20. When the supporting clip 34 is used in conjunction with the positioning clip 32, the positioning clip 32 is enclosed in the supporting clip 34, the connecting plate 320 of the positioning clip 32 is placed on the fixing plate 340 of the supporting clip 34, the two flexible wings 322 of the positioning clip 32 are aligned in parallel with the two supporting wings 342 of the supporting clip 34 and are clamped in between the two supporting wings 342 of the supporting clip 34. The slotting regions 324 of the two flexible wings 322 of the positioning clip 32 clamp with the two slots 429 of the column 428, thus clamping the column 428 to the fastening component 30. Meanwhile, the inside of the two supporting wings 342 of the supporting clip 34 rests on the corresponding two sides of the column 428, thus further supporting the column 428, which may be assembled more reliably to the lighting frame 20. In addition, the bottom ends of the corresponding two sides of the column 428 may also form two "V" shaped slots 429, thereby the slotting regions 344 of the two supporting wings 342 of the supporting clip 34 may further clamp to the slots 429 on the bottom ends of the two sides of the column 428, thus securing the housing structure with the positioning clip 32. Since the housing structure 42 is clamped to the lighting frame 20 through the fastening components 30, the assembling and disassembling of the LED module 40 is straightforward, and as a result, the cost of labors and resources may be effectively reduced.

Figure 11:
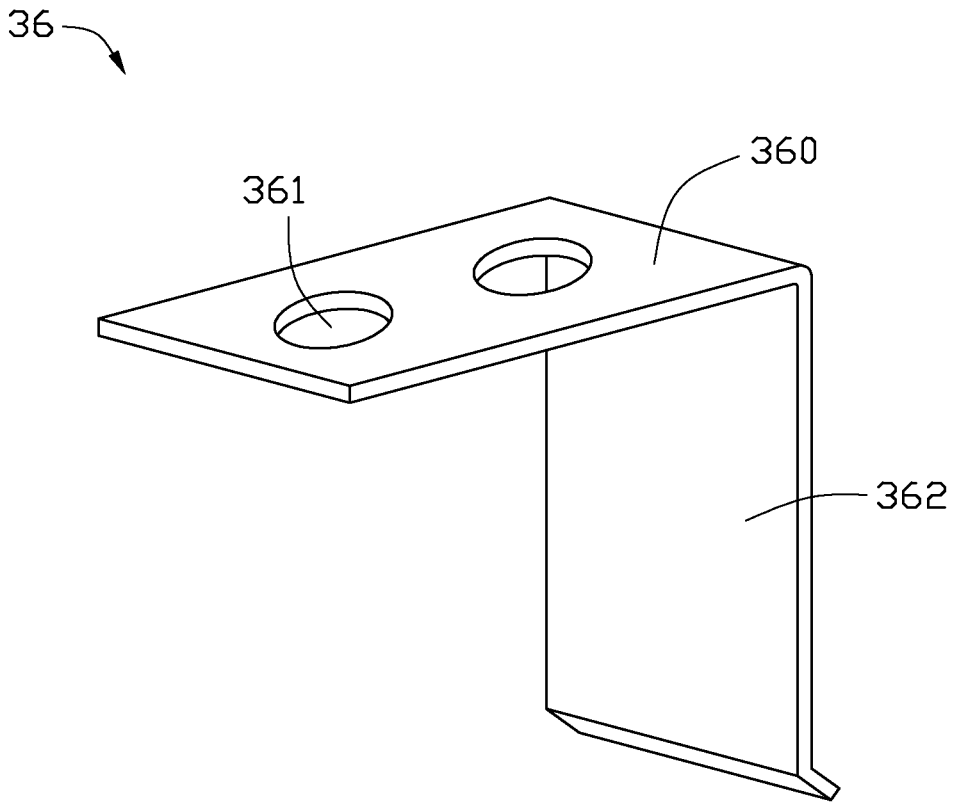
FIG. 11 is an enlarged view of the limiting plate of the LED lighting device of FIG. 1.
Figure 12:
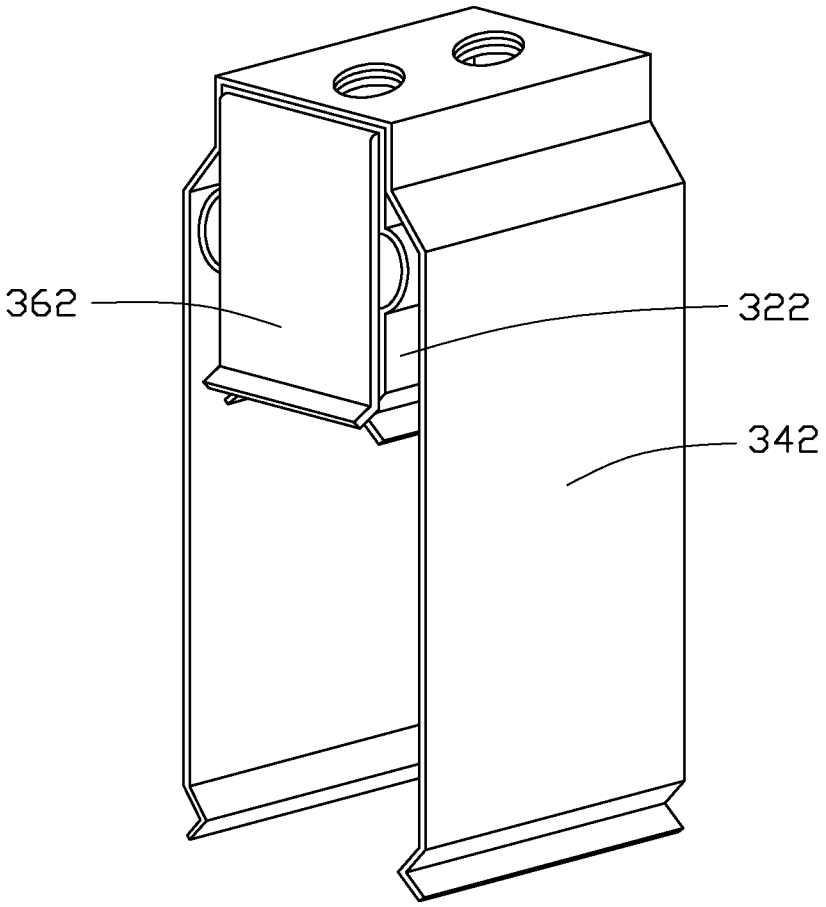
FIG. 12 is an assembled view of the positioning clip of FIG. 8, the supporting clip of FIG. 9 and the limiting plate of FIG. 11.
Figure 13:
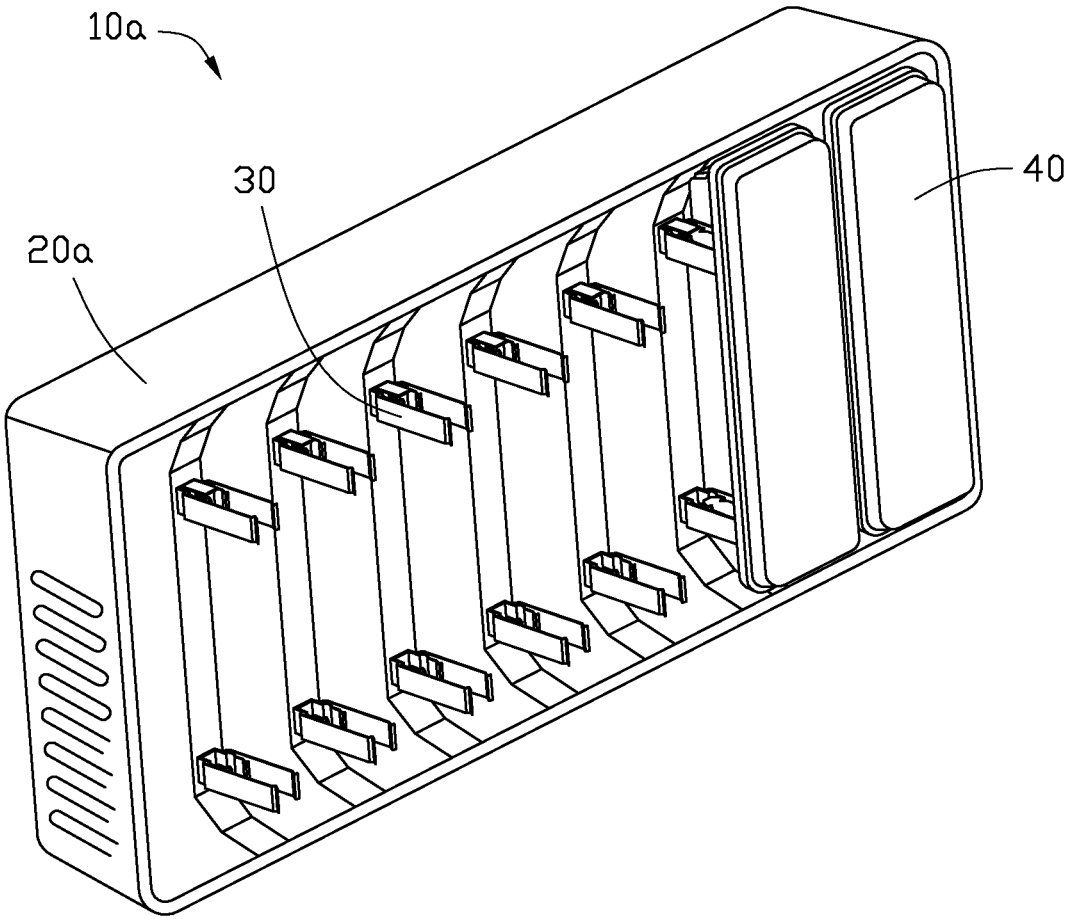
FIG. 13 is a three-dimensional isometric illustration of the LED lighting device according to third embodiment of the present invention.
Figure 14:
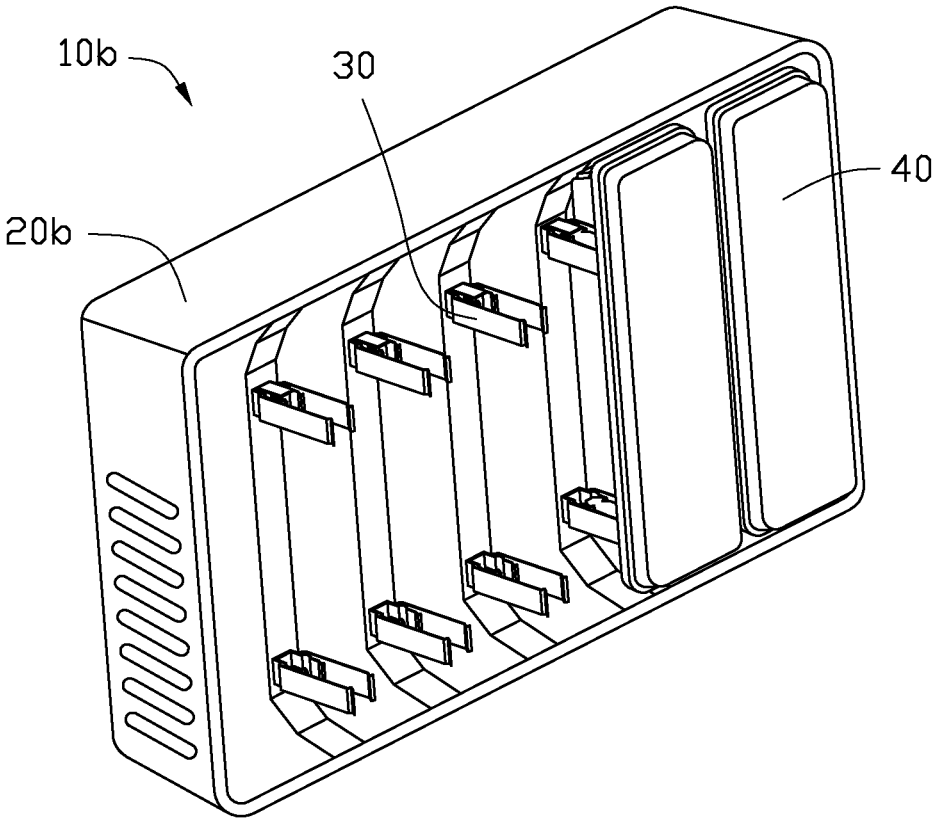
FIG. 14 is a three-dimensional isometric illustration of the LED lighting device according to fourth embodiment of the present invention.
Figure 15:
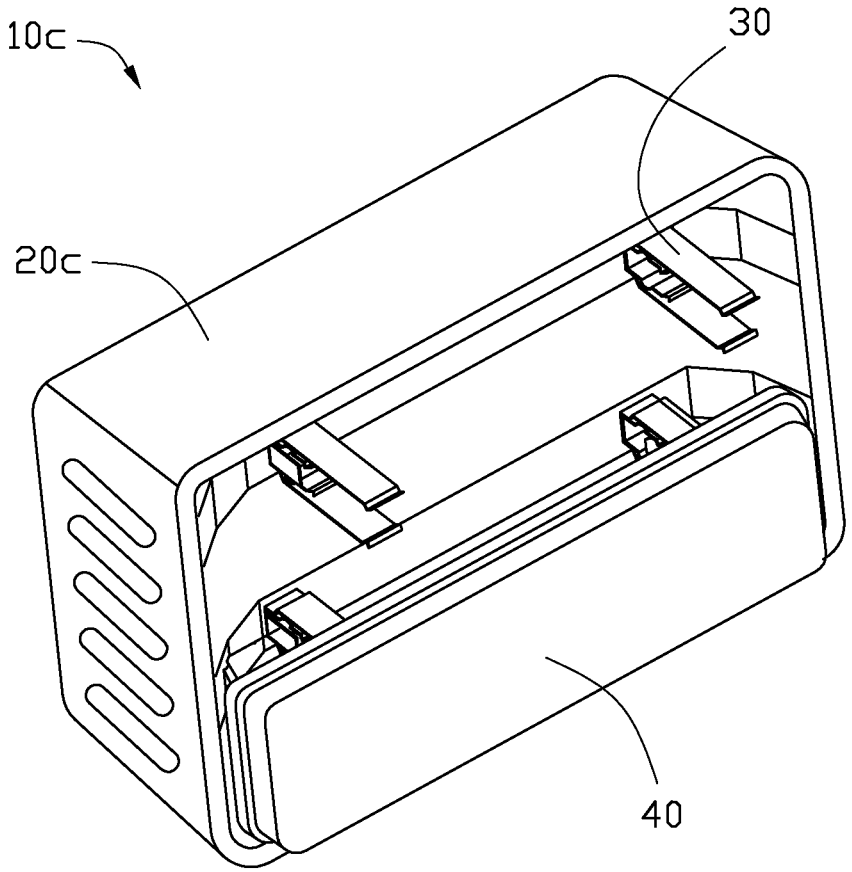
FIG. 15 is a three-dimensional isometric illustration of the LED lighting device according to fifth embodiment of the present invention.

Referring to FIGS. 11-12, the fastening component 30 may further include a limiting plate 36. The limiting plate 36 includes an installing plate 360 and a supporting plate that extends in perpendicular to one side of the installing plate 360. The installing plate 360 includes two internal threads 361, and the end of the supporting plate 362 inclines outward. The width of the installing plate 360 is less than that of the connecting plate 320, and the length of the supporting plate 362 is less than that of the flexible wing 322. When the limiting plate 36 is used in conjunction with the positioning clip 32 and the supporting clip 34, the fixing plate 340 of the supporting clip 34, the connecting plate 320 of the positioning clip 32 and the installing plate 360 of the limiting plate 36 are stacked in order in the cavity 200 of the lighting frame 20. The screws are fastened to the lighting frame 20 through the internal threads 361, 321, 341 of the installing plate 360, the connecting plate 320 and the fixing plate 340, respectively, thus securing the limiting plate 36, positioning clip 32 and supporting clip 34 to the lighting frame 20. Meanwhile, the two flexible wings 322 of the positioning clip 32 are aligned in parallel to the two supporting wings 342 of the supporting clip 34 and are located in between the inside of the two supporting wings 342, the supporting plate 362 of the limiting plate 36 is aligned in perpendicular to the two flexible wings 322 of the positioning clip 32 and is located away from the two flexible wings 322 of the positioning clip 32 and the two supporting wings 342 of the supporting clip 34. The slots 429 of the column 428 are clamped by the two slotting regions 324 of the positioning clip 32, the corresponding two sides are clamped by the two supporting wings 342 of the supporting clip 34, and the other side is supported by the supporting plate 362 of the limiting plate 36. Thus, the column 428 is secured in three directions by the fastening component 30. In particular, the fastening component 30 that includes a limiting plate 36 may be used to secure, for example, the LED module 40 of a playground lighting device 10*a*, as shown in FIG. 13, which comprises the LED modules 40 that are tilted horizontally, thus requiring the limiting plate 36 to supports the column 428 from beneath. In addition, a tunnel lighting device 10*b* as shown in FIG. 14, a highway bridge railing lighting device 10*c* as shown in FIG. 15 and other types of lighting devices may also adopt the fastening components 30 to secure the LED modules 40. Because of the differences in illumination angles, different lighting device may use a single-element (for example, the positioning clip 32), two-elements (for example, the positioning 32 and the supporting clip 34) or three-elements of the fastening component 30, according to the actual needs. In addition, the quantity of the fastening components 30 for different lighting device varies with respect to the quantity of the LED modules 40 used. For example, since the playground lighting device 10*a* requires a larger illuminating area, thus a higher quantity of the LED modules 40 is needed. For that reason, the rectangular lighting frame 20*a* of the playground lighting device 10*a* comprises fourteen fastening components 30 in corresponds to seven LED modules 40. The tunnel lighting device 10*b* requires a relatively smaller illuminating area, thus the rectangular lighting frame 20*b* comprises ten fastening components 30 to secure five LED modules 40. The highway bridge railing lighting device 10*c* requires a smallest illuminating area, thus the rectangular lighting frame 20*c* only comprises four fastening components 30 to secure two LED modules 40. Moreover, the positioning clip 32, the supporting clip 34 and the limiting plate 36 of the fastening component 30 may be constructed in one piece, instead of the aforementioned separate constructions.

Figure 16:
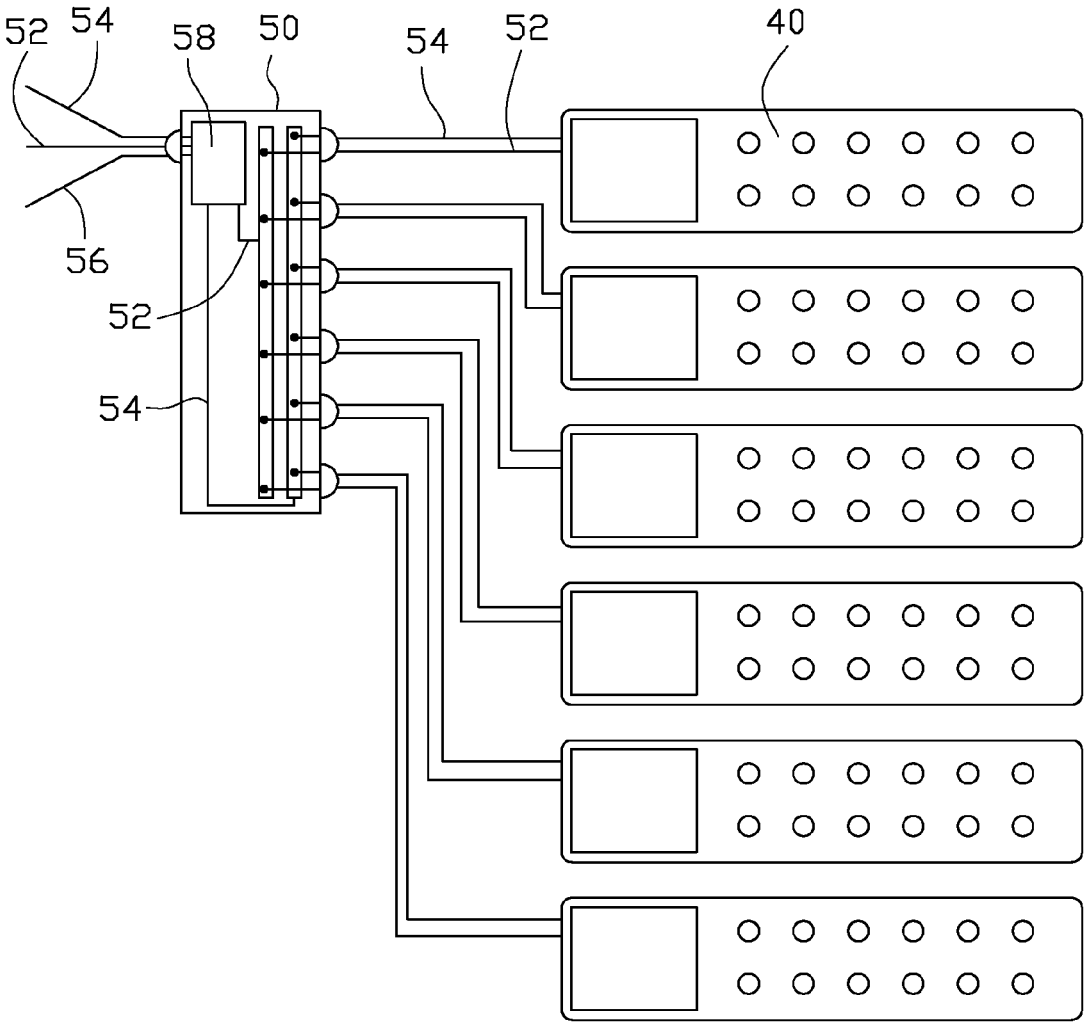
FIG. 16 is a diagrammatic illustration of an electric circuit of the LED lighting device of FIG. 1.

Referring to FIG. 16, the inside of the lighting frame 20 includes a grid power distribution box 50 that provides power to each individual LED module 40. The input of the grid power distribution box 50 includes a live wire 52, a neutral wire 54 and an earth wire 56. With the neutral wire acts as the standard point, the time variant positive and negative voltage received by the live wire 52 forms a potential difference with the neutral wire 54, resulting in alternating current. The earth wire 56 is connected to the lighting frame 20 to prevent electric shock. The grid power distribution box 50 includes a lightning protection device 58, which comprises lightning electrical components such as varistors. According to the quantity of the LED modules 40, a plurality of the live wires 52 and the neutral wires 54 are pulled out from the output of the lightning protection device 58, thereby connecting each power converter 44 of the LED modules 40 with a live wire 52 and a neutral wire 54. Thus, the LED lighting device 10 may provides power to each LED module 40 through the grid power distribution box 50.

Since each power converter 44 of the LED modules 40 operates independently from each other, a damaged power converter 44 of the LED module 40 does not affect the operations of the other LED modules, thereby maintaining the illumination of the LED lighting device 10. In addition, the maintenance or replacement work on the LED modules 40 may begin only when a plurality of the LED modules 40 have failed, instead of carrying out maintenance or replacement work each time a single LED module has failed, thereby reducing the maintenance cost.

It is appreciated that, apart from the aforementioned LED lighting device 10, the playground lighting device 10*a*, the tunnel lighting device 10*b* and the highway bridge railing lighting device 10*c*, the LED module 40 of the present invention may also applies to other types of lighting devices such as garden lights, patio lights, plaza lights, corridor lights and etc.

The embodiments shown and described above are only examples. Many details are often found in the art such as the other features of a LED LIGHTING DEVICE. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An LED module, comprising:

a housing structure including a cooling mechanism and a substrate;

a plurality of light emitting diodes;

a power converter which provides power to the LEDs and converts alternating current to direct current; and a lampshade, wherein the lampshade is detachably fixed to the housing structure, the lampshade forms a concave; the substrate comprises at least one protruding part located corresponding to the location of the concave; and the LED module further comprises at least one flexible hook that connects between the concave and the at least one protruding part.

2. The LED module of claim 1, wherein the housing structure comprises a cavity formed on the substrate, and the cavity comprises a housing space which encloses the power converter.

3. The LED module of claim 1, wherein the cooling mechanism comprises at least one fin.

4. The LED module of claim 1, wherein the power converter comprises a power factor correction and power output module, at least one switch and a micro control unit, and the micro control unit digitally controls the power factor correction and power output module through the at least one switch to models a resistive load.

5. The LED module of claim 4, wherein the power converter comprises a first filtering protection module and a second filtering protection module coupled to the two ends of the power factor correction and power output module, and the micro control unit further connects to the first filtering protection module and the second filtering protection module.

6. The LED module of claim 5, wherein the power converter includes a current-voltage collecting module coupled to the second filtering protection module, and the current-voltage collecting module transmits the feedback readings of the current and the voltage of the second filtering protection module to the micro control unit.

7. The LED module of claim 1, wherein the lampshade includes a bottom plate and a sidewall formed on the bottom plate; the bottom plate comprises at least one opening that encloses the LEDs; and the inner sidewall of the opening comprises a reflective layer.

8. The LED module of claim 1, wherein the LED module further comprises a reflector that covers the LEDs; the reflector comprises at least one opening that exposes the LEDs; the reflector is located away from the surface of the substrate and the inner sidewall of the at least one opening is coated with a chrome layer; and the chrome layer is located away from the surface of the substrate the reflector faces.

9. The LED module of claim 1, wherein the LED is disposed on the substrate through an aluminum electric circuit board, the aluminum electric circuit board forming an electrical connection with the power converter.

10. The LED module of claim 1, wherein the housing structure is constructed with electrical insulating and thermal conducting materials, and the power converter is non-isolated connected to the housing structure.

11. An LED lighting device, comprising:

a plurality of LED modules, each comprising:

a housing structure including a cooling mechanism and a substrate;

a plurality of light emitting diodes;

a power converter which provides power to the LEDs and converts alternating current to direct current; and a lampshade, wherein the lampshade is detachably fixed to the housing structure; and wherein each power converter of the LED modules operates independently.

12. The LED lighting device of claim 11, further comprising: a grid power distribution box, the grid power distribution box transmitting alternating current to the power converter of each of the LED modules, and each power converter converts alternating current to direct current and transmits direct current to the LEDs.

13. The LED lighting device of claim 12, wherein the grid power distribution box comprises a lightning protection device, the input of the lightning protection device having a live wire, a neutral wire and an earth wire, and the output of the lightning protection device connects to each of the LED modules with a live wire and a neutral wire.

14. The LED lighting device of claim 11, further comprising: a lighting frame; and the housing structure of each of the LED module attaches to and separates from the lighting frame through a plurality of fastening components.

15. The LED lighting device of claim 14, wherein the housing structure of each of the LED module comprises at least one column formed on the substrate, and each of the plurality of fastening components comprises a positioning clip that clamps with the column.

16. The LED lighting device of claim 15, wherein the end of the column forms two slots, and the positioning clip comprises a connecting plate that connects to the lighting frame and two flexible wings that extend from the opposite sides of the connecting plate, the end of each flexible wing forming a slotting region that clamps with the slots of the column.

17. The LED lighting device of claim 14, wherein each of the plurality of fastening components comprises a supporting clip having a fixing plate that connects with the lighting frame and two supporting wings that extend from the opposite sides of the fixing plate, and the two supporting wings support the opposite sides of the column.

18. The LED lighting device of claim 17, wherein each of the plurality of fastening components further comprises a limiting plate having an installing plate that connects with the lighting frame and a supporting plate that extends from one side of the installing plate, and the supporting plate supports the other side of the column.

19. The LED lighting device of claim 18, wherein the fixing plate of the supporting clip, the connecting plate of the positioning clip and the installing plate of the limiting plate stack on the lighting frame.

20. A light emitting diode module, comprising:

a housing structure that includes a cooling mechanism and a substrate;

a light emitting diode;

a power converter that provides power to the light emitting diode and converts alternating current to direct current; and a lampshade that is detachably fixed to the housing structure;

wherein, the lampshade forms a concave; the substrate comprises at least one protruding part located corresponding to the location of the concave; and the LED module further comprises at least one flexible hook that connects between the concave and the at least one protruding part.

* * * * *